United States Patent [19]

Feleus

[11] 4,100,876

[45] Jul. 18, 1978

[54] HYDROFOIL FIXED STRUT STEERING CONTROL

[75] Inventor: Christiaan C. Feleus, Kent, Wash.

[73] Assignee: The Boeing Company, Seattle, Wash.

[21] Appl. No.: 797,984

[22] Filed: May 18, 1977

[51] Int. Cl.[2] ..... B63B 1/18

[52] U.S. Cl. ..... 114/274; 114/281; 244/206

[58] Field of Search ..... 114/274, 275, 280, 281; 244/206

[56] References Cited

U.S. PATENT DOCUMENTS

| | | | |
|---|---|---|---|
| 1,879,594 | 9/1932 | Trey | 244/206 |
| 3,183,871 | 5/1965 | Reder | 114/281 |
| 3,448,714 | 6/1969 | Brooks | 244/206 |

*Primary Examiner*—Trygve M. Blix
*Assistant Examiner*—D. W. Keen
*Attorney, Agent, or Firm*—Thomas H. Murray

[57] ABSTRACT

Apparatus for steering a hydrofoil ship by the combination of one or more trailing-edge or spade rudders in combination with means for controlling the side forces on a vertical, fixed strut or horizontal foil which pierces the water. The means for controlling side forces comprises an elongated roller or rollers mounted on the leading edge of the strut or foil. In the case of the vertical strut, the roller is stationary and has no effect when the craft is not turning. However, when turning, the roller is rotated about its own axis in the direction of the turn to produce a pressure decrease which minimizes the resistance to water flow on the side facing the direction of turn. In the case of a horizontal foil, the roller rotates in a direction to decrease pressure on the upper surface and increase it below, thereby creating greater lift.

3 Claims, 4 Drawing Figures

HYDROFOIL FIXED STRUT STEERING CONTROL

BACKGROUND OF THE INVENTION

As is known, in a hydrofoil seacraft of the submerged foil type, the hull of the craft is lifted out of the water by means of foils which are carried on struts and pass through the water beneath the surface thereof. In passing through the water, and assuming that sufficient speed is attained, the foils create enough lift to raise the hull above the surface and, hence, eliminate the normal resistance encountered by a ship hull in passing through the water.

In the usual case, there are forward and aft foils, both provided with control flaps similar to those used on aircraft. The other essential element is the rudder which pierces or is submerged beneath the surface of the water and is either forward or aft of the craft, depending upon its design. In most hydrofoils, the flaps are used primarily to cause the craft to ascend or descend and to control the craft about its pitch and roll axes; however they can also be used in combination with the rudder to bank the ship about its roll axis during a turn.

Steering and holding against the moments generated by beam winds had been a continual problem in hydrofoil craft until the fully-swiveled strut for steering was introduced. In such an arrangement, a strut, usually the forward strut, is pivoted about an essentially-vertical axis and pivots along its entire length to effect a turn. The fully-swiveled strut has been used extensively, and has effectively eliminated any serious problems in steering and maintaining positive directional control of hydrofoil craft.

The degree of improvement in directional control for such a hydrofoil craft with the use of a fully-swiveled strut, however, has not been attained without some penalties. That is, the fully-swiveled strut involves added costs, added weight, and added complexity. Moreover, as hydrofoils become larger, the costs and complexities associated with the fully-swiveled strut become greater and greater. In some present-day hydrofoils, for example, the strut alone weighs about 7.8 long tons. Consequently, the implementation of a means for actuating the strut under the forces encountered during a turn becomes increasingly difficult.

Prior attempts at steering a hydrofoil craft without using a swiveled strut involved the utilization of trailing-edge rudders on a fixed strut, spade rudders below the foils, forced-air ventilation of the strut to generate side forces without trailing-edge or spade rudders, and various other methods associated with ventilation of one side or the other of the strut. These attempts have all been singularly unsuccessful in that they have not been able to provide smooth, positive control forces. As a result, they are not employed on present-day hydrofil ships of the fully-submerged foil type.

SUMMARY OF THE INVENTION

In accordance with the present invention, a steering control for hydrofoil craft is provided comprising a non-rotatable vertical strut element secured to the bottom portion of the hydrofoil craft, a submergible foil element carried at the bottom of the strut, a rotatable rudder operatively associated with at least one of said elements, and means incorporated into said strut for varying the flow of liquid on a side surface thereof during a turn to reduce the side forces on the strut opposing the turn.

Another aspect of the invention resides in the provision of one or more rotatable rollers at the leading edge of the foil carried at the lower end of the strut for increasing the lift produced by the foil.

In the preferred embodiment of the invention, trailing-edge or spade rudders are employed in combination with at least one or more rollers mounted at the leading edge of the strut, the roller being exposed to liquid impining on the leading edge of the strut as the hydrofoil craft traverses the surface of a body of water. Normally, the roller does not rotate when the hydrofoil craft is not turning whereby the forces on opposite sides of the strut will be substantially the same. However, during a turn, the roller rotates about its axis in the direction of the turn to produce a pressure decrease on one side of the strut to reduce side forces opposing the turn.

The principle of operation of the invention is based upon the basic principles of hydrofoil ship turning using 100% coordinated turns. For such a turning method, the total side force on the struts is zero and the forces to accomplish the turn are generated by the foil system. In this turning method, however, it is difficult to provide zero side force on the strut. For a canard configured craft with steering control on the forward strut, for instance, the angle of attack on the forward strut builds up with turn rate, due to the fact that the ship is pivoting around the aft struts. Mathematically, the angle of attack on such a strut in a 100% coordinated turn is given by the equation:

$$\beta_s = \frac{(X_{Fwd} + X_{Aft})\,R}{u_o} \cos \phi$$

where:

$\beta_s$ = the angle of attack;

$X_{Fwd}$ = longitudinal distance from the craft center of gravity to the forward strut;

$X_{Aft}$ = longitudinal distance from the craft center of gravity to the aft struts;

$R$ = the ship turn rate in the earth's axis;

$u_o$ = the ship forward velocity; and $\phi$ = the ship roll angle.

There will occur a side force on such a strut which is proportional to the side-slip angle, $\beta$, when the strut is wetted which is contrary to the above-described law that requires the side forces on all struts to be zero. Thus, in a fully-coordinated turn, a hydrofoil craft with a fully-swiveled steering strut rotates the strut an amount equal and opposite to the side-slip angle, $\beta$, so that the full angle of attack on the strut is zero. On a ship employing a fixed strut for steering, alternate means are required to generate a side force equal to and opposite the forces due to the strut side-slip angle $\beta$. Trailing-edge and spade rudders have been used for this purpose, but without great success.

The present invention resides in the discovery that when means are incorporated in the hydrofoil steering system to limit and control the side force build-up on the strut opposing the turn, and at the same time means are provided to generate positive, well-controlled forces in the direction of the turn, turning with a fixed steering strut will be greatly enhanced.

The above and other objects and features of the invention will become apparent from the following detailed description taken in connection with the accompanying drawings which form a part of this specification, and in which.

Figure 1:
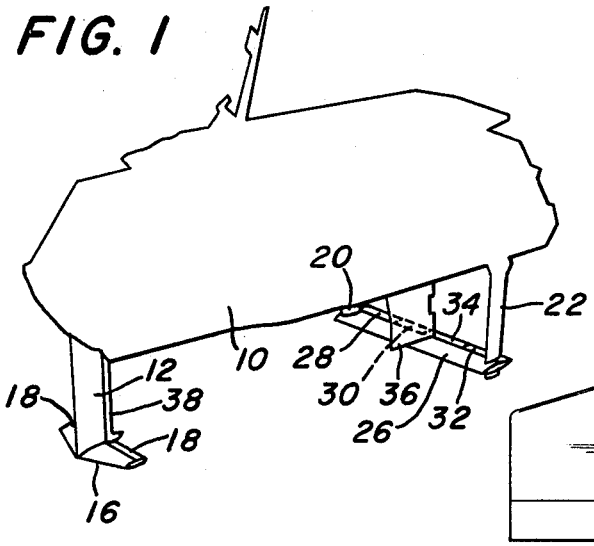
FIG. 1 is a schematic perspective view of a hydrofoil craft with which the present invention may be employed.

With reference now to the drawings, and particularly to FIG. 1, the outline of a hydrofoil craft is indicated generally by the reference numeral 10. Connected to the hull of the craft 10 is a forward, fixed strut 12 which can be rotated upwardly about a horizontal axis by means, not shown, to clear the surface of the water when the craft is operating as a conventional displacement ship. The strut, however, is fixed in a plane extending along the longitudinal axis of the craft. (i.e., It cannot turn about a vertical axis.) Carried on the lower end of the strut 12 is a forward foil 16 which carries at its trailing edge control surfaces or flaps 18 which are interconnected and normally operate in synchronism.

In the aft portion of the craft, struts 20 and 22 are pivotally connected to the hull of the craft 10 and can be rotated downwardly about a horizontal axis into the position shown in FIG. 1 for foil-borne operation or can be rotated backwardly and upwardly when the craft operates as a conventional displacement ship. Extending between the lower ends of the struts 20 and 22 is an aft foil 26 which carries, at its trailing edge, two starboard flaps 28 and 30 and two port flaps 32 and 34. Each set of starboard flaps and each set of port flaps normally operate in synchronism; however each flap in the port or starboard pair is normally provided with a separate hydraulic actuating system as well as a separate electrical servo system for redundancy and safety purposes so that one can operate even though the electrical or hydraulic system for the other should fail.

Carried between the struts 20 and 22 and pivotally connected to the hull of the craft 12 with the struts is a gas turbine-water jet propulsion system 36 which provides the forward thrust for the craft during foil-borne operation. Essentially, the system 36 sucks water upwardlly into a turbine driven by a jet engine or other prime mover, the water exiting from the turbine being discharged from the lower edge of the assembly 36 in order to provide forward thrust.

The forward strut 12 is provided with a trailing-edge rudder 38 which can rotate about a vertical axis in order to effect turning of the craft. During a turn, the two port flaps 32, 34, for example, will be rotated downwardly while the starboard flaps 28 and 30 are rotated upwardly, thereby causing the craft to bank to the starboard side as is more fully described in U.S. Pat. No. 3,886,884 assigned to the Assignee of the present application. After the craft is once banked, the trailing-edge rudder 38 will be rotated to effect a starboard turn.

As was mentioned above, many prior art hydrofoil craft utilized a forward strut 12 which was itself pivotal about a vertical axis along its entire length to effect turning of the craft. This, however, produces undesirable side forces on the strut which oppose the turn due to the side-slip angle on the strut.

Figure 2:
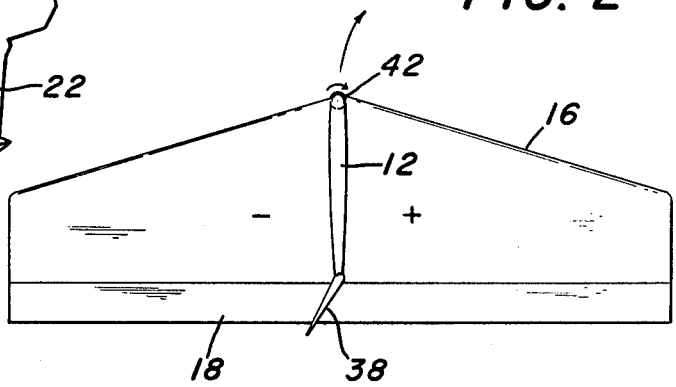
FIG. 2 is a top view of an embodiment of the invention wherein a rotatable roller is carried at the leading edge of a fixed strut to equalize forces thereon.
Figure 3:
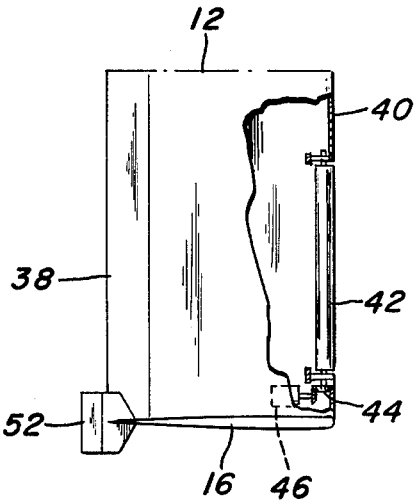
FIG. 3 is a partially broken-away elevational view of the embodiment of the invention shown in FIG. 2, illustrating the arrangement of the rotatable roller at the leading edge of the fixed strut.

In accordance with the present invention, the forward strut 12 is not swiveled about a vertical axis but instead remains stationary. As shown in FIG. 2, the trailing-edge rudder 38 is employed to effect a turn, for example, to the starboard side. As best shown in FIG. 3, the forward or leading edge 40 is provided with a roller 42 rotatable about a vertical axis and driven through bevel gears 44 by a reversible motor 46. When making a starboard turn, for example (FIG. 2), the motor 46 is actuated to rotate the roller 42 in a clockwise direction as viewed from the top. This tends to suck water from the left side of the strut and force it to the right side. This reduces the side forces on the left or port side of the strut opposing the turn. Of course, it will be appreciated that when the craft turns to the port side, the trailing-edge rudder 38 will be rotated in the opposite direction and the roller 42 caused to rotate in a counterclockwise direction whereby the forces on the starboard side of the strut opposing the turn are reduced.

Figure 4:
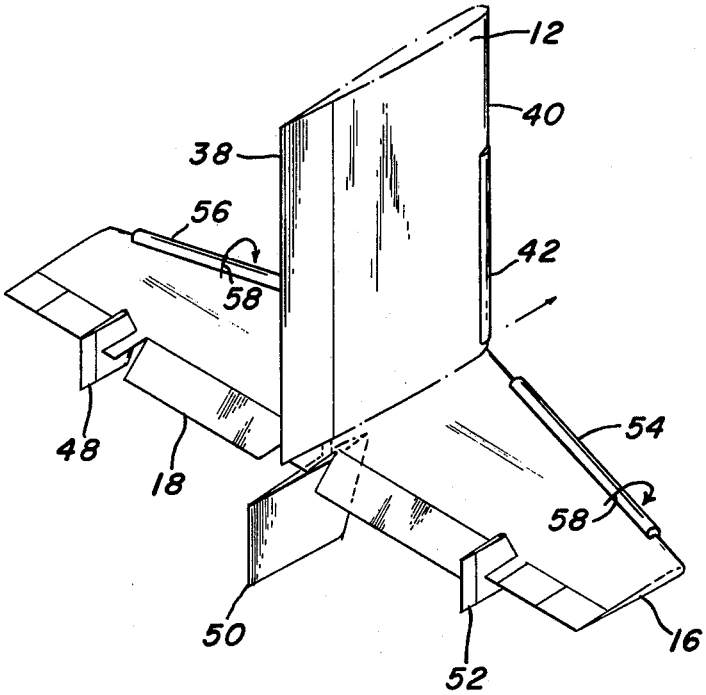
FIG. 4 is a perspective view showing the roller arrangement of FIGS. 2 and 3 in combination with rollers on the leading edge of a foil carried on the bottom of the fixed strut.

In the embodiment of FIG. 4, elements corresponding to those of FIGS. 2 and 3 are identified by like reference numerals. The trailing-edge rudder 38 is again utilized at the trailing end of the strut 12, but in addition three spade rudders 48, 50 and 52 are attached to or are beneath the flap 18 to assist in turning the craft. Furthermore, in the embodiment of FIG. 4, two rollers 54 and 56 are provided on the leading edges of the foil 16 and rotate in the direction of arrows 58. This tends to suck water from the top of the foil and force it beneath it, thereby improving the lift characteristics of the foil. The rollers 54 and 56 will continually rotate in the direction of arrows 58 as the foil passes through the water.

Although the invention has been shown in connection with certain specific embodiments, it will be readily apparent to those skilled in the art that various changes in form and arrangement of parts may be made to suit requirements without departing from the spirit and scope of the invention. In this regard, it will be apparent that cavitation devices such as spoilers or air jets projecting outwardly from the sides of the strut can be used to assist the roller in reducing side forces on the strut.

I claim as my invention:

1. A steering control for hydrofoil craft comprising a non-rotatable vertical strut element secured to the bottom portion of the craft, a submergible foil element carried at the bottom of said strut, a trailing edge rotatable rudder operatively associated with at least one of said elements, at least one rotatable roller mounted at the leading edge of said strut, said roller being exposed to liquid impinging on the leading edge of the strut as the hydrofoil craft traverses the surface of a body of water, said roller being stationary when the hydrofoil craft is not turning whereby the forces on opposite sides of the strut will be substantially the same, and means for rotating said roller in coordination with said rudder during a turn of the hydrofoil craft to thereby reduce side forces on the strut which are opposing the turn.

2. The steering control of claim 1 including a reversible drive motor for rotating the roller.

3. The steering control of claim 1 wherein the roller is rotatable about a substantially vertical axis and is caused to rotate during a turn in the direction of the turn in coordination with said rudder.

* * * * *